US008459154B2

(12) United States Patent
Lai

(10) Patent No.: US 8,459,154 B2
(45) Date of Patent: Jun. 11, 2013

(54) HAND-HELD TOOL

(75) Inventor: Ching Kuei Lai, Taichung (TW)

(73) Assignee: Tiee Sheng Enterprise Co., Ltd, Taichung (TW)

( * ) Notice: Subject to any disclaimer, the term of this patent is extended or adjusted under 35 U.S.C. 154(b) by 323 days.

(21) Appl. No.: 13/045,488

(22) Filed: Mar. 10, 2011

(65) Prior Publication Data

US 2012/0227549 A1 Sep. 13, 2012

(51) Int. Cl.
*B25B 23/16* (2006.01)

(52) U.S. Cl.
USPC ..... 81/177.2; 81/177.1; 81/177.5; 81/177.6

(58) Field of Classification Search
USPC ..... 81/177.1, 177.2, 177.5, 177.6
See application file for complete search history.

(56) References Cited

U.S. PATENT DOCUMENTS 5,943,921 A * 8/1999 Lin ..... 81/59.1
6,131,490 A * 10/2000 Lee ..... 81/63.1
7,481,135 B2 * 1/2009 Schoenbeck et al. ..... 81/177.7

* cited by examiner

*Primary Examiner* — Lee D Wilson
*Assistant Examiner* — Shantese McDonald

(57) ABSTRACT

A hand-held tool includes a shaft, a grip movably sleeved on the shaft, a pivot seat pivotally mounted to a rear end of the shaft, a first positioning set is mounted into a terminal of the shaft relative to the pivot seat, a second positioning set embedded into an interior of the grip, an end-piece mounted onto a rear end of the grip, a tubular element rotatably mounted onto a front end of the grip and a limit set extending through the front end of the grip for limiting a rotating range of the tubular element. The total length and the shape of the hand-held tool is changeable sue to the relation between the grip and the shaft.

8 Claims, 9 Drawing Sheets

HAND-HELD TOOL

BACKGROUND OF THE INVENTION

1. Field of the Invention

The present invention relates to a hand-held tool, and more particularly to a hand-held tool that has an extensible handle.

2. Description of Related Art

A conventional hand-held tool, such as a socket wrench, in accordance with the prior art comprises handle and a work head mounted to a front of the handle. The total length of the conventional hand-held tool is unchangeable. However, the torque is various relative to different operations. Some operators sleeve a metal tube on the handle for lengthening the lever arm of the conventional hand-held tool when the torque is great. It is very dangerous because there is no positioning element between the handle of the hand-held tool and the metal tube.

In addition, an L-shaped metal tube is necessary when the axis of the work piece is parallel to the handle. The disadvantage is the same as the foregoing hand-held tool.

The present invention has arisen to mitigate and/or obviate the disadvantages of the conventional hand-held tools.

SUMMARY OF THE INVENTION

The main objective of the present invention is to provide an improved hand-held tool that has an extensible handle.

To achieve the objective, the hand-held tool in accordance with the present invention comprises a shaft including a shank and a work head connected to a front end of the shank. A annular groove and a curved groove are respectively and peripherally defined in the shank. The annular groove and curved groove respectively correspond to the front end and a rear end of the shaft. A bore longitudinally defined in the rear end of shank. A grip is movably sleeved on the shank. The grip includes a through hole longitudinally defined therein and the rear end of the shank extends into through hole. A trough is defined in a front end of the grip and communicates with the through hole. A cavity is defined in an interior of the through hole and corresponds to the trough. A threaded hole is defined in the grip and communicates with the through hole, wherein the threaded hole is front of the cavity relative to the grip. A pivot seat includes a body pivotally connected to a rear end of the shank. A cavity is longitudinally defined in the body for pivotally receiving the rear end of the shank. A groove is defined in the body and laterally communicates with the cavity in the body to allow the shank being wiggled relative to the pivot seat. A through hole is radially defined in the body. A first positioning seat is mounted into the bore and selectively engaged into the through hole in the pivot seat for positioning the shaft after being wiggled. A second positioning set is mounted into the cavity in the grip and selectively engaged into the annular groove and the curved groove. An end-piece is mounted onto a rear end of the grip for closing the through hole in the grip. A tubular element is rotatably mounted to a front end of the grip. The tubular element includes a passage laterally defined therein and selectively communicating with the trough to allow the shank passing through the tubular element and the grip. A slot is peripherally defined in the tubular element and communicates with the threaded hole. A limit set is screwed through the threaded hole and partially received in the slot in the tubular element for limiting a rotating range of the tubular element.

Further benefits and advantages of the present invention will become apparent after a careful reading of the detailed description with appropriate reference to the accompanying drawings.

DETAILED DESCRIPTION OF THE INVENTION

Figure 1:
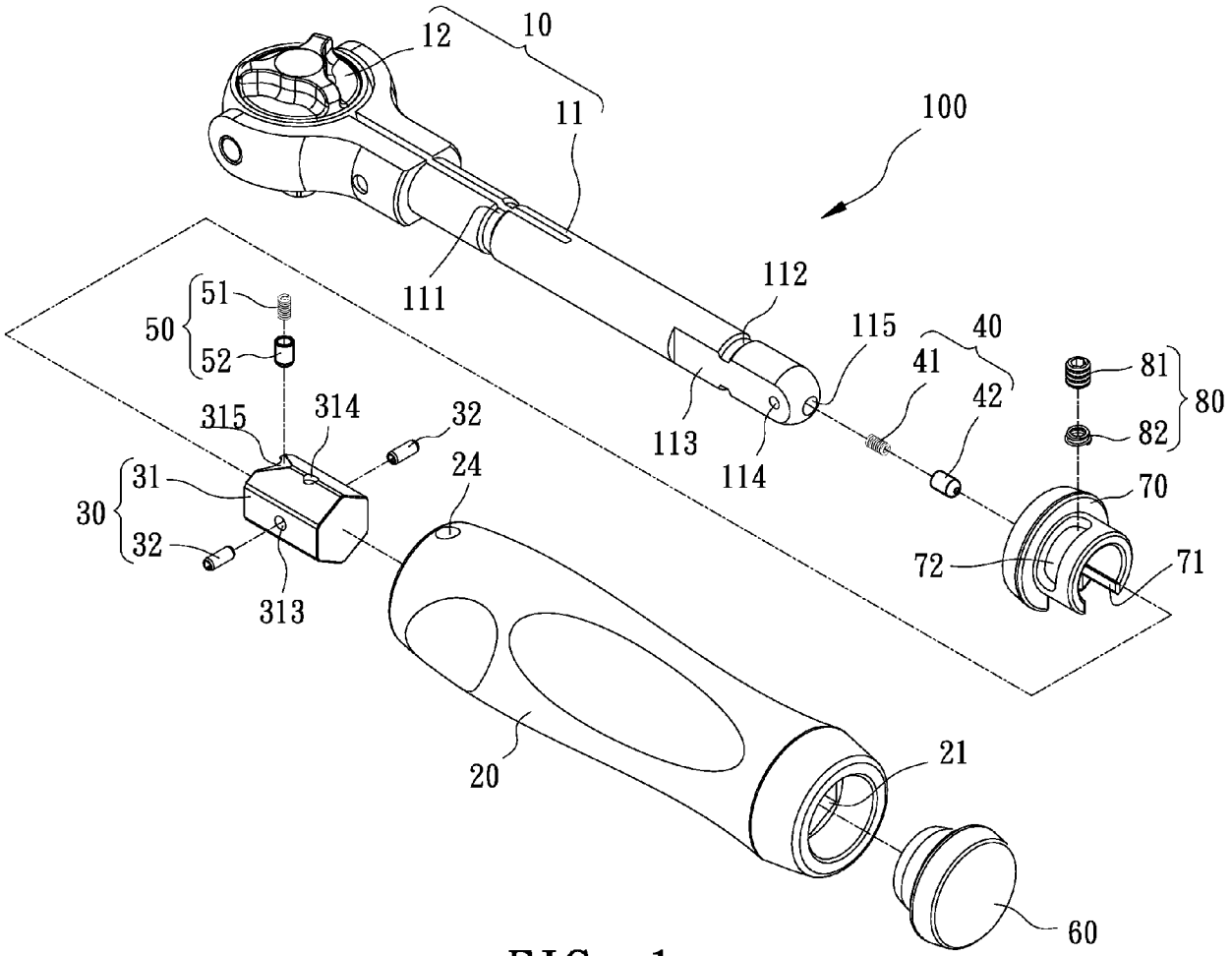
FIG. 1 is an exploded perspective view of a hand-held tool in accordance with the present invention.

Referring to the drawings and initially to FIG. 1, a hand-held tool (100) in accordance with the present invention comprises a shaft (10), a grip (20) movably sleeved on the shaft (10), a pivot seat (30) pivotally mounted to a rear end of the shaft (10), a first positioning set (40) is mounted into a terminal of the shaft (10) relative to the pivot seat (30), a second positioning set (50) embedded into an interior of the grip (10), an end-piece (60) mounted onto a rear end of the grip (20), a tubular element (70) rotatably mounted onto a front end of the grip (10) and a limit set (80) extending through the front end of the grip (20) for limiting a rotating range of the tubular element (70).

Figure 2:
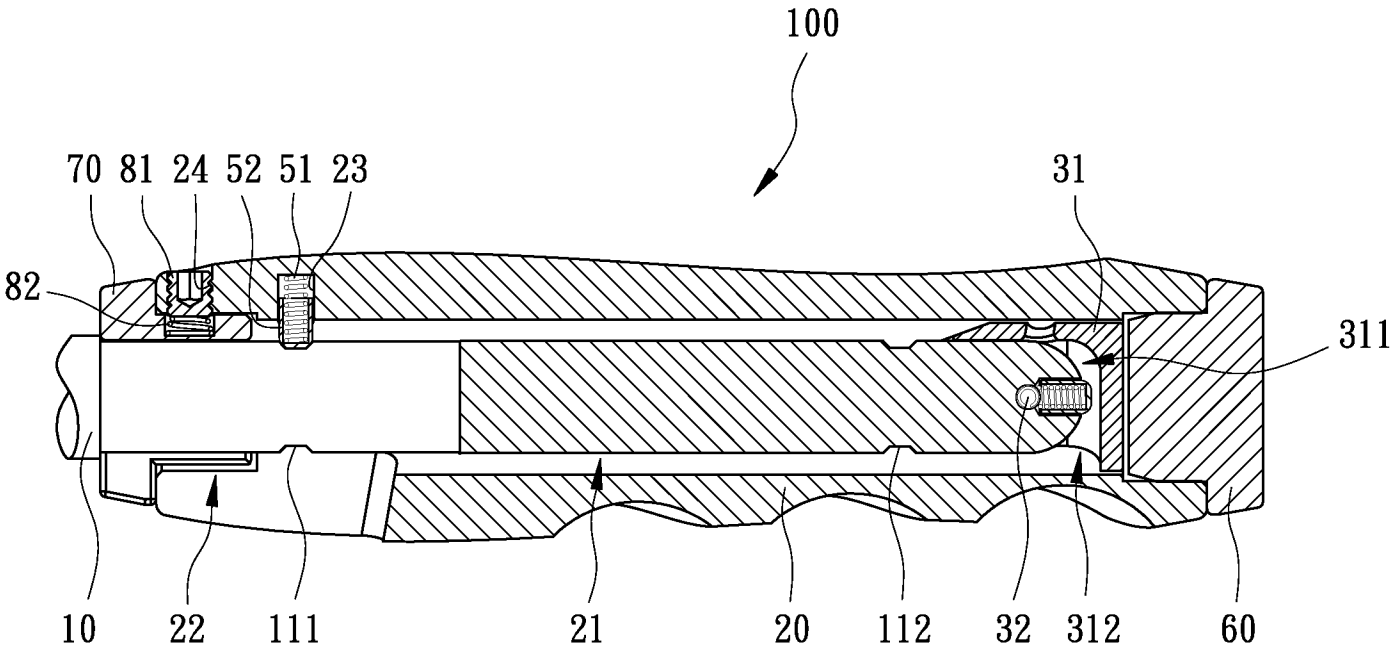
FIG. 2 is a partially cross-sectional view of the hand-held tool when the shaft is received in the grip.

With reference to FIGS. 1 and 2, the shaft (10) includes a shank (11) having a front end having a work head connected thereon for driving a workpiece (not shown). An annular groove (111) and a curved groove (112) are respectively and peripherally defined in the shank (11). A flat portion (113) is formed on a rear end of the shank (11). A first pivot hole (114) is defined in the flat portion (113) and transversely extends through the shank (11). A bore (115) is longitudinally defined in the rear end of the shank (11).

The grip (20) includes a through hole (21) longitudinally defined therein and has non-round cross-section. In the preferred embodiment of the present invention, the cross-section of the through hole (21) is hexagon. A trough (22) is laterally defined in a front end of the grip (20) and communicating with the through hole (21), and has a width slightly wider than that of the plat portion (113). A cavity (23) is defined in an interior of the through hole (21) and corresponds to the trough (22). A threaded hole (24) is defined in the grip (20) and communicates with the through hole (21), wherein the threaded hole (24) is front of the cavity (23) relative to the grip (20).

The pivot seat (30) includes a body (31) pivotally mounted to the rear end of the shank (11) and partially receiving the plat portion (113). The body (31) has a cross-section complementally corresponding to that of the through hole (21) in the grip (20) and is reciprocally moved in the through hole (21) in the grip (20). A cavity (311) is longitudinally defined in the body (31) for pivotally receiving the plat portion (113). A groove (312) is defined in the body (31) and laterally communicates with the cavity (311) in the body (31) to allow the shank (11) being wiggled relative to the pivot seat (30). The body (31) has a second pivot hole (313) defined therein and extending therethrough. A through hole (314) is radially defined in the body (31). A tapered plane (315) is formed on a front end of the body (31) and corresponds to the cavity (23) in the grip (20). Two pivots (32) respectively extend through two opposite ends of the second pivot hole (313) and pivotally inserted into two opposite ends of the first pivot hole (114) for pivotally mounting the rear end of the shank (11) to the body (31).

Figure 6:
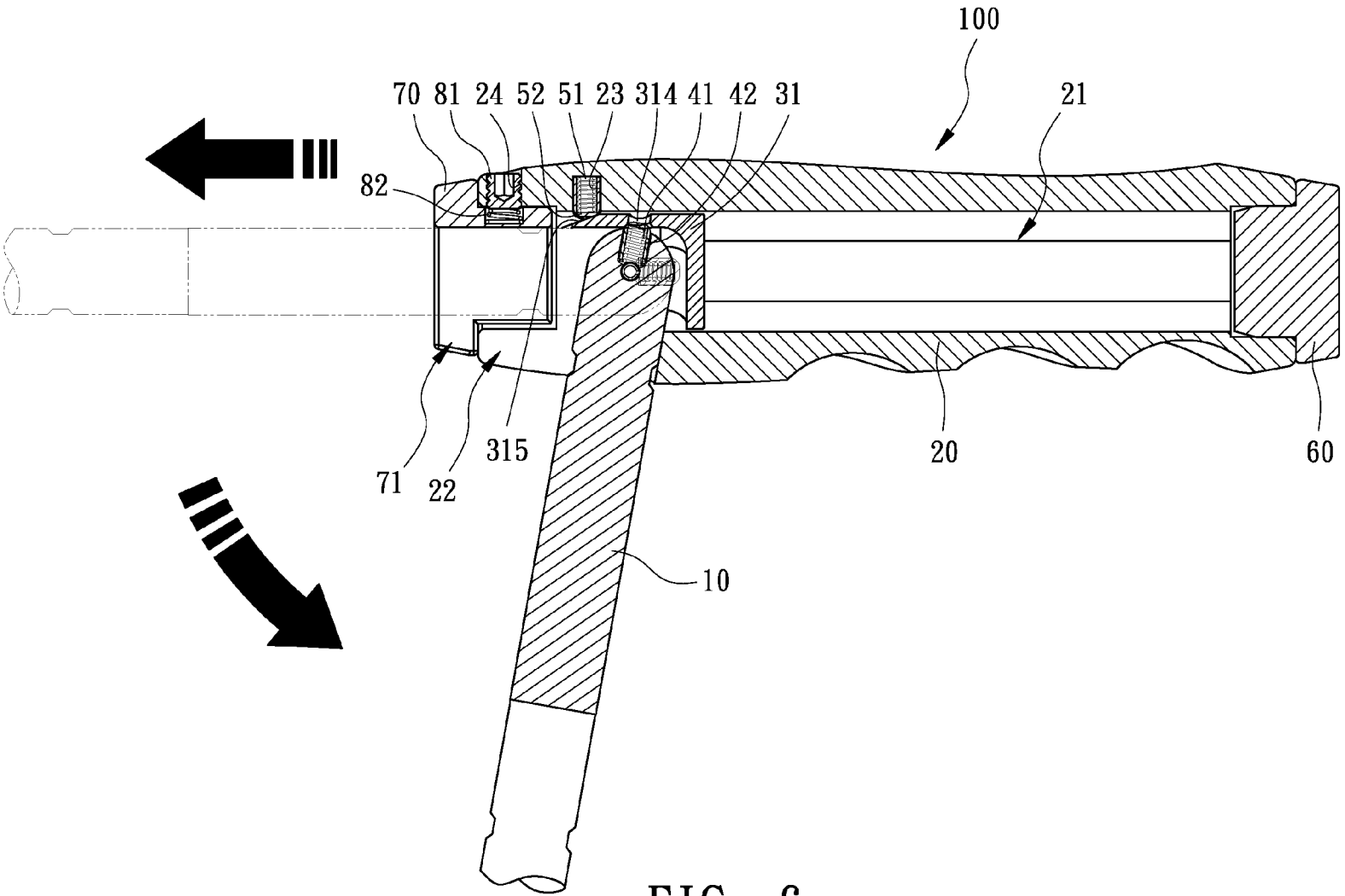
FIG. 6 is an operational view of the hand-held tool in accordance with the present invention.
Figure 7:
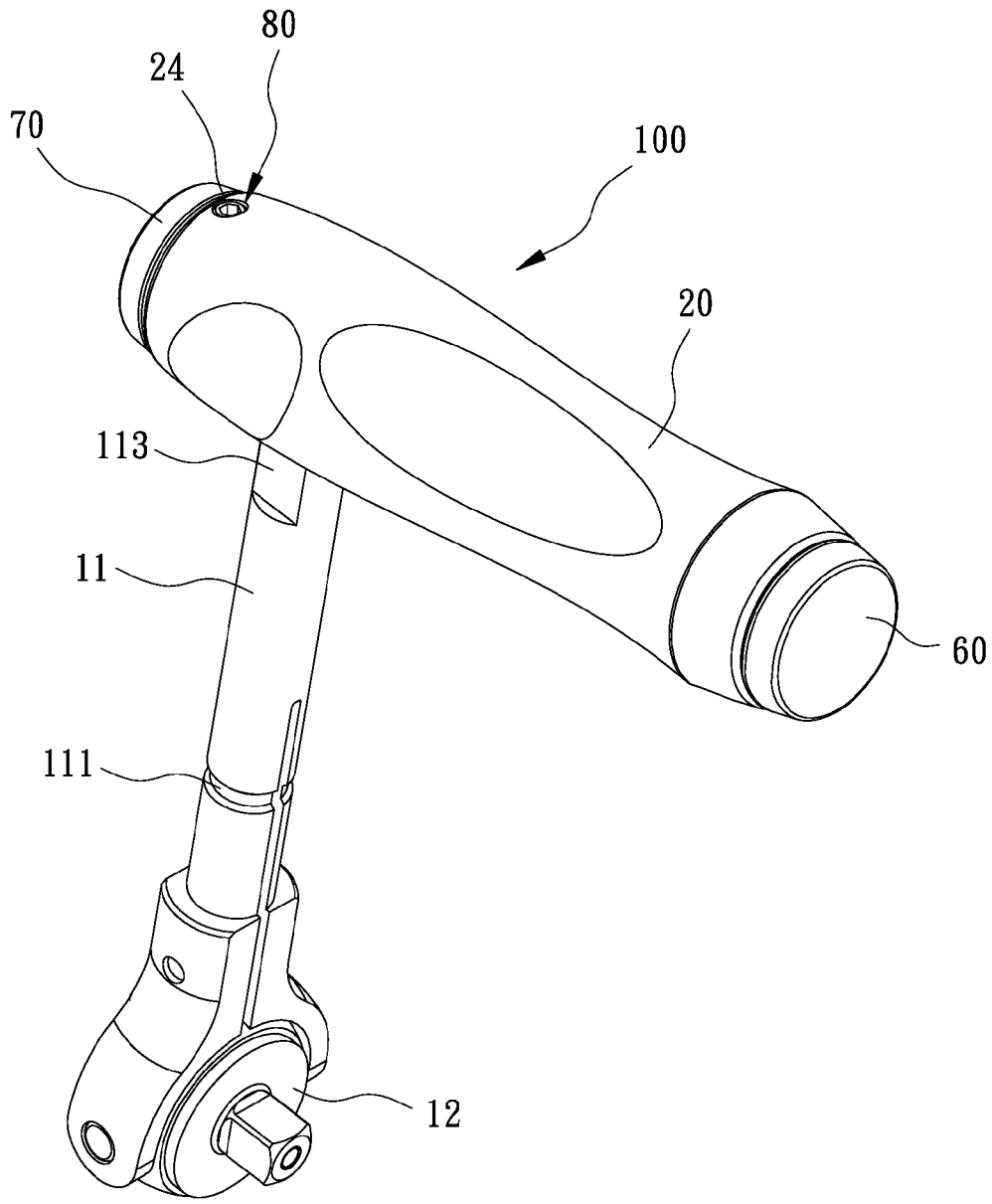
FIG. 7 is a schematic view of the hand-held tool in accordance with the present invention.

The first positioning set (40) includes a first spring (41) and a first cap (42) sequentially mounted into the bore (115) such that the first cap (42) is reciprocally moved relative to the shank (11) due to the restitution force of the first spring (41). The first cap (42) has a diameter greater than that of the through hole (314) in the body (31) and selectively partially engaged into the through hole (314) in the body (31), as shown in FIG. 6.

The second positioning set (50) includes a second spring (51) and a second cap (52) sequentially mounted into the cavity (23) in the grip (20) such that the second cap (52) is reciprocally radially moved relative to the grip (20) due to the restitution force of the second spring (51). The second cap (52) is engaged into the annular groove (111) when the shank (11) moved into the through hole (21) in the grip (20) and the second cap (52) is engaged into the curve groove (112) when the shank (11) outwardly extends from the grip (20). In addition, the second cap (52) is moved back into the cavity (23) in the grip (20) to compress the second spring (51) due to the tapered plane (315), as shown in FIG. 6, when wiggling the shank (11).

The end-piece (60) is longitudinally mounted to a rear end of the grip (20) for closing the through hole (21) in the grip (20).

The tubular element (70) includes a passage (71) laterally defined therein and selectively communicating with the trough (22) to allow the shank (11) passing through the tubular element (70) and the grip (20). A slot (72) is peripherally defined in the tubular element (70) and communicates with the threaded hole (24).

The limit set (80) includes a third spring (82) and a blot (81) respectively and sequentially mounted into the slot (72) in the tubular element (70) and the threaded hole (24). Consequently, the third spring (82) is compressively disposed between the bolt (81) and the periphery of the shank (11).

With reference to FIG. 2, the shaft (10) is moved into the grip (20) and the second cap (52) is engaged into the annular groove (111). Consequently, the total length of the hand-held tool in accordance with the present invention is shortened for easily stored. However, the shortened hand-held tool of the present invention still can be used to an operation that does not need a great torque.

Figure 3:
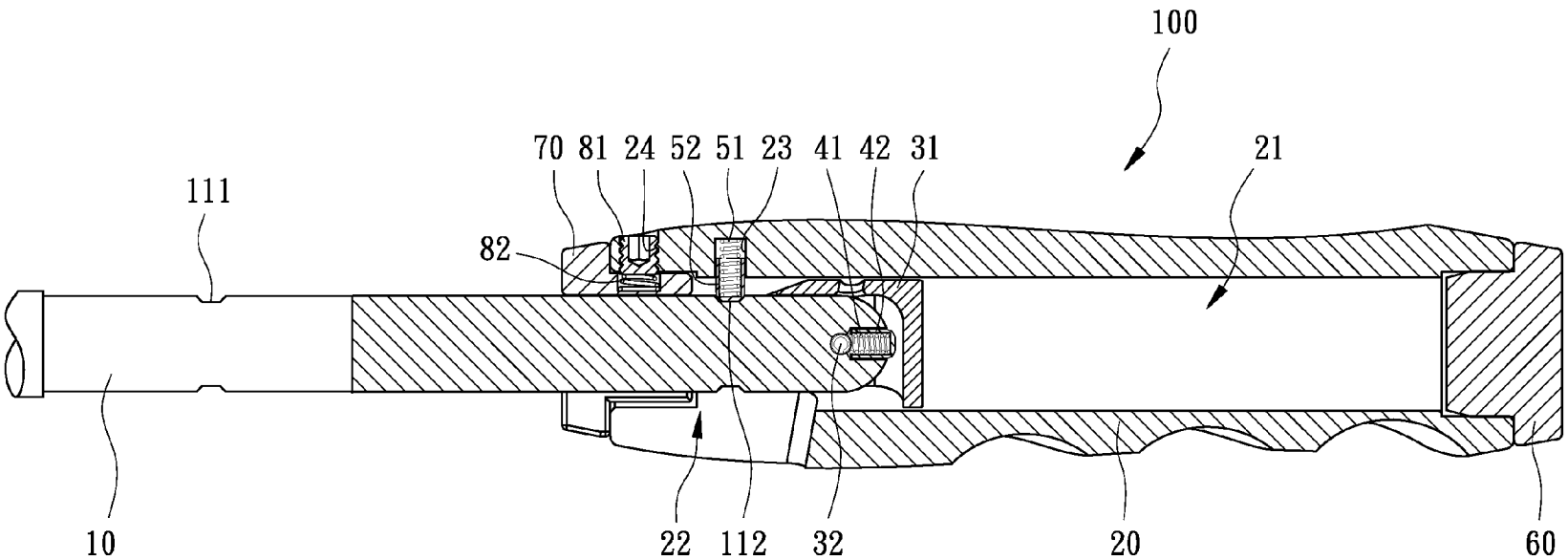
FIG. 3 is a partially cross-sectional view of the hand-held too when the shaft is extended from the grip.
Figure 4:
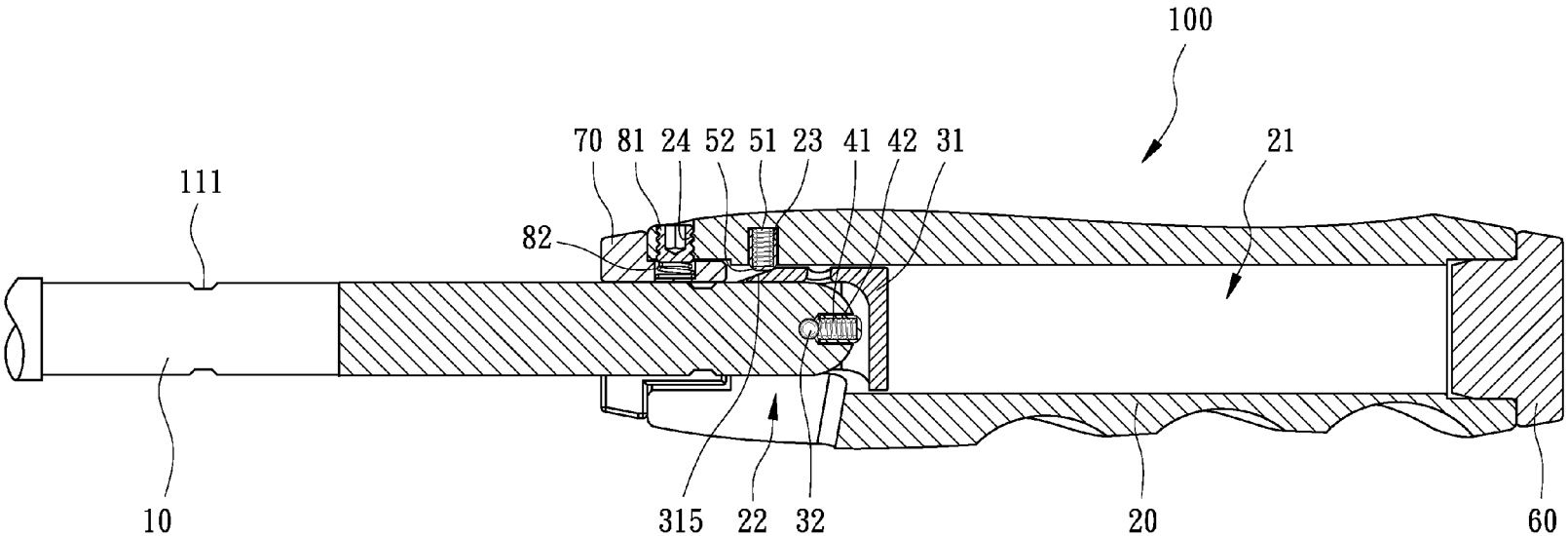
FIG. 4 is an operational view of the hand-held tool before wiggling the shaft relative to the grip.
Figure 5:
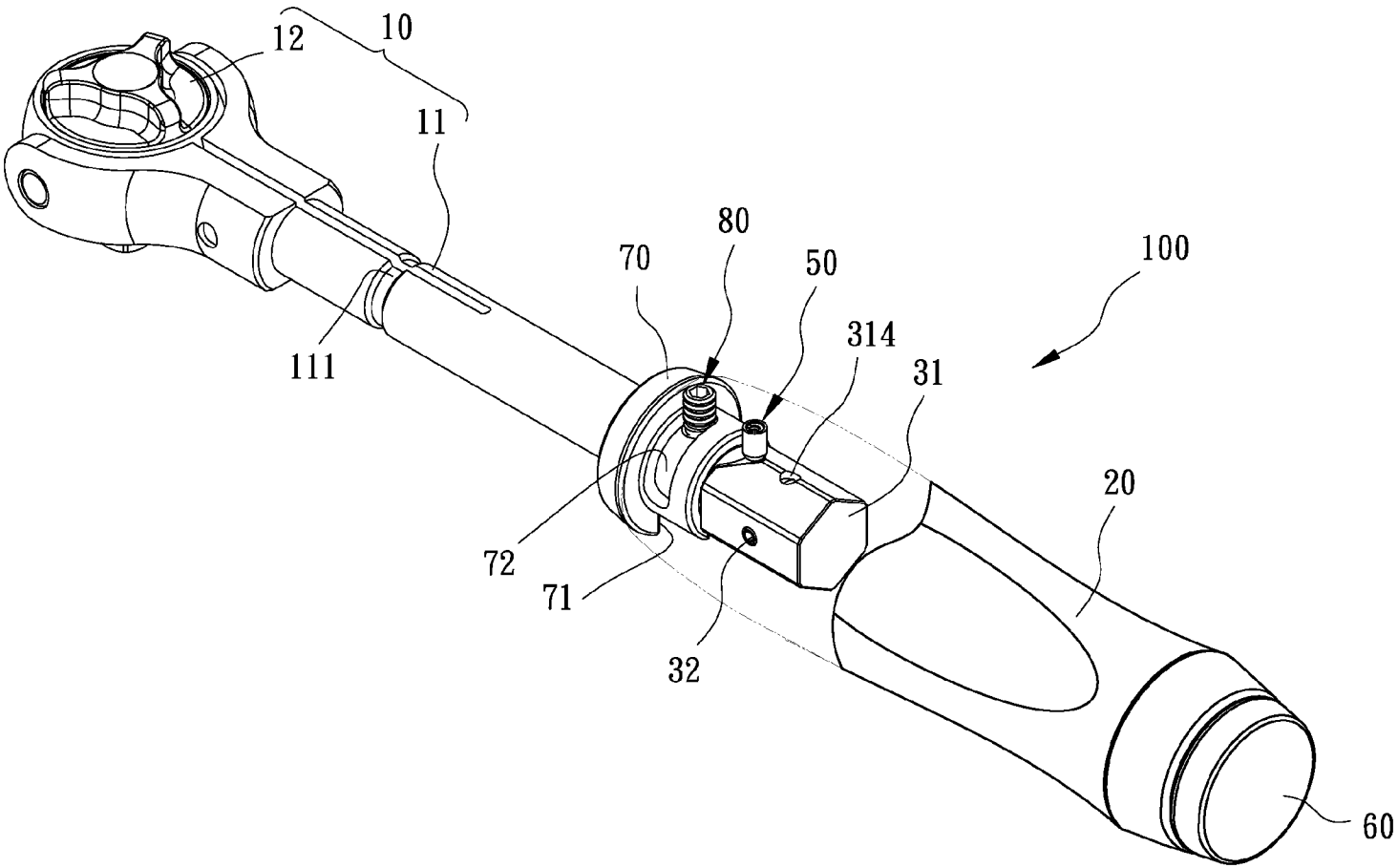
FIG. 5 is a perspective view of the hand-held tool in partial fluoroscopy before wiggling the shaft relative to the grip.

With reference to FIG. 3, the shaft (10) extending from the grip (20) and the second cap (52) is engaged into the curved groove (112) such that the total length is lengthened relative to the tool in FIG. 2 and a the lever arm of the present invention is lengthened for an operation that need a great torque.

Figure 8:
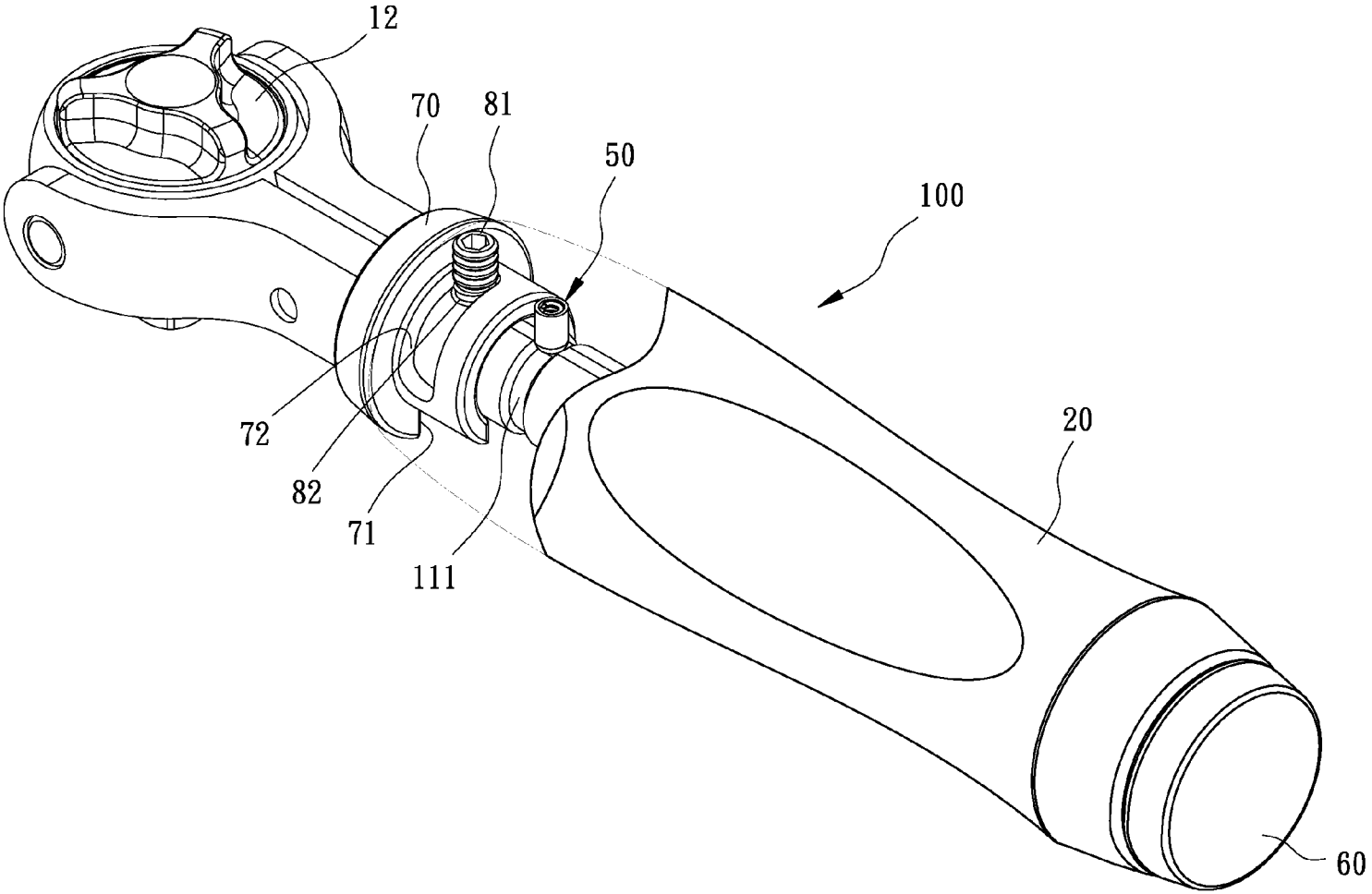
FIG. 8 is a perspective view of the hand-held tool in accordance with the present invention when the shaft moved into the grip.

With reference to FIGS. 4 through 8, hand-held tool of the present invention can be used when forming a T-shaped. The shaft (10) is completely extended relative to the grip (20) and the tapered plane (315) inward pushes the second cap (52) to compress the second spring (51). The tubular element (70) is rotated to make the passage (71) communicating with the through hole (21) in the grip (20) via the trough (22), as shown in FIG. 8. The shaft (10) is wiggled to form a T-shape with the grip (20) for providing a greater use scope to the hand-held tool and the wiggled shaft (10) is positioned when the first cap (42) engaged into the through hole (314) in the body (31).

Figure 9:
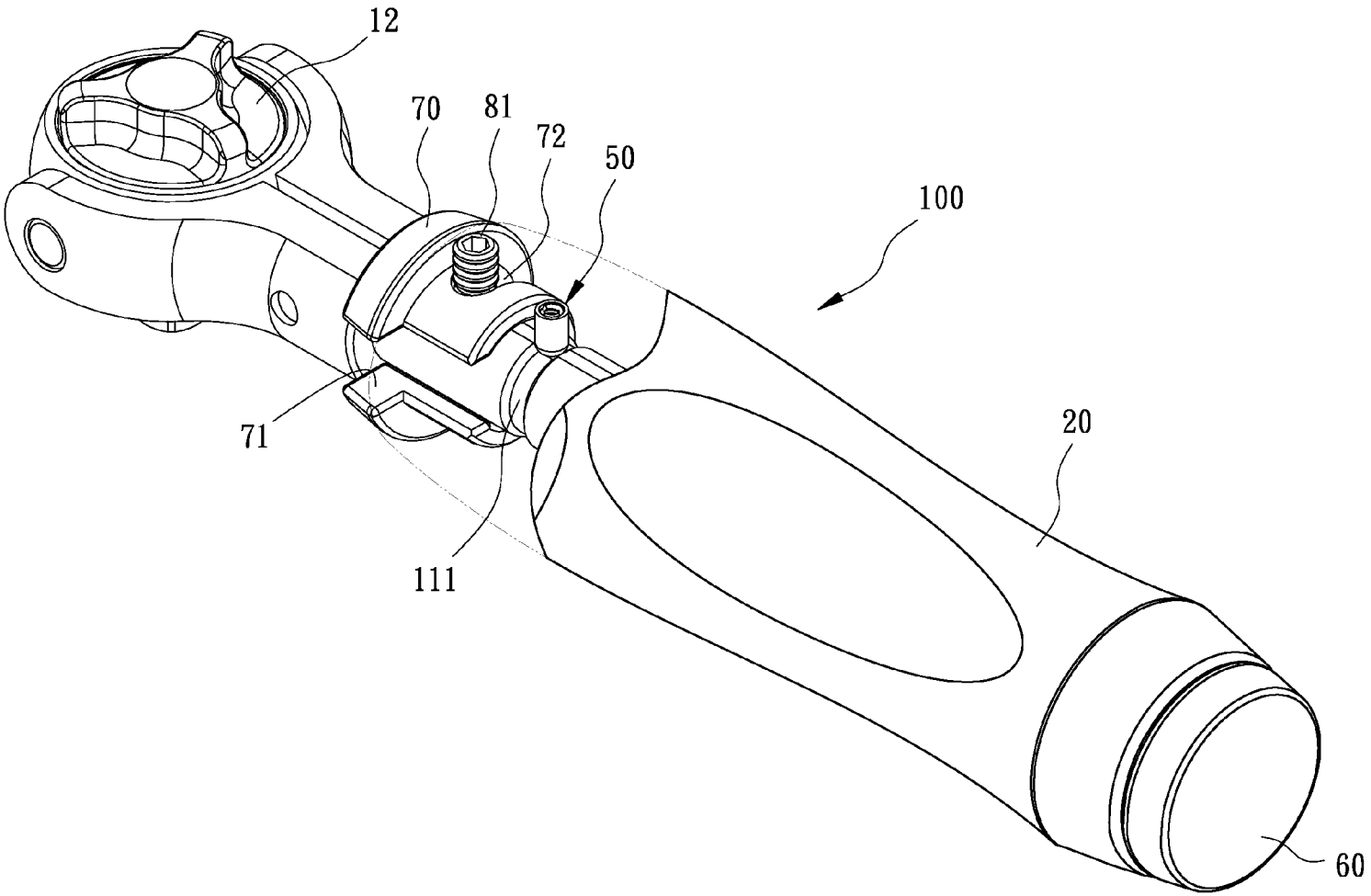
FIG. 9 is perspective view of the hand-held tool in accordance with the present invention when the shaft moved into the grip and the holder is rotated to support the shaft.

With reference to FIG. 9, the bolt (81) is extended into slot (72) in the tubular element (70) such that the rotating range of the tubular element (70) is limited.

Although the invention has been explained in relation to its preferred embodiment, it is to be understood that many other possible modifications and variations can be made without departing from the spirit and scope of the invention as hereinafter claimed.

What is claimed is:

1. A hand-held tool comprising:

a shaft including a shank and a work head connected to a front end of the shank, a annular groove and a curved groove respectively and peripherally defined in the shank, the annular groove and curved groove respectively corresponding to the front end and a rear end of the shaft, a bore longitudinally defined in the rear end of shank;

a grip movably sleeved on the shank and including a through hole longitudinally defined therein and the rear end of the shank extending into through hole, a trough defined in a front end of the grip and communicating with the through hole, a cavity defined in an interior of the through hole and corresponding to the trough, a threaded hole defined in the grip and communicating with the through hole, wherein the threaded hole is front of the cavity relative to the grip;

a pivot seat including a body pivotally connected to a rear end of the shank, a cavity longitudinally defined in the body for pivotally receiving the rear end of the shank, a groove defined in the body and laterally communicating with the cavity in the body to allow the shank being wiggled relative to the pivot seat, a through hole radially defined in the body;

a first positioning seat mounted into the bore and selectively engaged into the through hole in the pivot seat for positioning the shaft after being wiggled;

a second positioning set mounted into the cavity in the grip and selectively engaged into the annular groove and the curved groove;

an end-piece mounted onto a rear end of the grip for closing the through hole in the grip;

a tubular element rotatably mounted to a front end of the grip, the tubular element including a passage laterally defined therein and selectively communicating with the trough to allow the shank passing through the tubular element and the grip, a slot peripherally defined in the tubular element and communicating with the threaded hole;

a limit set screwed through the threaded hole and partially received in the slot in the tubular element for limiting a rotating range of the tubular element.

2. The hand-held tool as claimed in claim 1, wherein the shank includes a flat portion formed the rear end thereof, the flat portion having a width slightly smaller than that of the cavity in the pivot seat.

3. The hand-held tool as claimed in claim 2, wherein the shank includes a first pivot hole defined in the flat portion and transversely extending through the shank, and the body of the pivot seat includes a second pivot hole defined therein and extending therethrough, two pivots respectively extending through the two opposite ends of the second pivot hole and pivotally inserted into two opposite ends of the first pivot hole for pivotally mounting the rear end of the shank to the body.

4. The hand-held tool as claimed in claim 1, wherein the through hole in the grip has a polygonal cross-section and the body of the pivot seat has a cross-section corresponding to that of the through hole in the grip such that the body of the pivot seat can not be rotated relative to the grip.

5. The hand-held tool as claimed in claim 1, wherein the body of the pivot seat has a tapered plane formed on a front end thereof for pushing second positioning set when the shank is wiggled and forms a T-shape with the grip.

6. The hand-held tool as claimed in claim 1, wherein the first positioning set includes a first spring and a first cap sequentially mounted into the bore such that the first cap is reciprocally moved relative to the shank due to the restitution force of the first spring, the first cap having a diameter greater than that of the through hole in the body and selectively partially engaged into the through hole in the body.

7. The hand-held tool as claimed in claim 1, wherein the second positioning set includes a second spring and a second cap sequentially mounted into the cavity in the grip such that the second cap is reciprocally radially moved relative to the grip sue to the restitution force of the second spring, the second cap engaged into the annular groove when the shank is moved into the through hole in the grip and the second cap engaged into the curve groove when the shank outwardly extends from the grip.

8. The hand-held tool as claimed in claim 1, wherein the limit set includes a third spring and a blot respectively and sequentially mounted into the slot in the tubular element and the threaded hole such that the third spring is compressively disposed between the bolt and the periphery of the shank.

* * * * *